US009458665B2

(12) United States Patent
Drifka et al.

(10) Patent No.: US 9,458,665 B2
(45) Date of Patent: Oct. 4, 2016

(54) NINETY DEGREE WIND LOCK WITH BREAK-AWAY CAPABILITY AND DOOR PANEL AND DOOR ASSEMBLY UTILIZING THE SAME

(71) Applicant: Rytec Corporation, Jackson, WI (US)

(72) Inventors: Brian Drifka, Richfield, WI (US); Raymond Sauve, Stone Mountain, GA (US); Andrew John Schumacher, West Bend, WI (US); Christopher Gontarski, Cedarburg, WI (US); Jeffrey Thomas Malinowski, Hartford, WI (US)

(73) Assignee: RYTEC CORPORATION, Jackson, WI (US)

( * ) Notice: Subject to any disclaimer, the term of this patent is extended or adjusted under 35 U.S.C. 154(b) by 23 days.

(21) Appl. No.: 14/150,381

(22) Filed: Jan. 8, 2014

(65) Prior Publication Data

US 2014/0190097 A1 Jul. 10, 2014

Related U.S. Application Data

(60) Provisional application No. 61/750,202, filed on Jan. 8, 2013.

(51) Int. Cl.

| | |
|---|---|
| ***A47G 5/02*** | (2006.01) |
| ***E06B 9/58*** | (2006.01) |
| *E06B 9/11* | (2006.01) |

(52) U.S. Cl.

CPC ..... *E06B 9/581* (2013.01); *E06B 9/11* (2013.01); *E06B 9/58* (2013.01); *E06B 2009/585* (2013.01)

(58) Field of Classification Search

CPC ..... E06B 9/11; E06B 9/13; E06B 9/40; E06B 9/58; E06B 9/581

USPC ..... 160/271, 272, 273.1, 268.1, 270, 265

See application file for complete search history.

(56) References Cited

U.S. PATENT DOCUMENTS

| | | | |
|---|---|---|---|
| 436,900 | A | 9/1890 | Morrison |
| 528,071 | A | 10/1894 | Branshaw |
| 766,541 | A | 8/1904 | Spiegle |

(Continued)

FOREIGN PATENT DOCUMENTS

| | | |
|---|---|---|
| EP | 0405093 | 1/1991 |
| FR | 2 086 841 A5 | 12/1971 |

(Continued)

OTHER PUBLICATIONS

Search Report from related PCT application No. PCT/US2014/010686 mailed Jul. 9, 2014, 13 pages.

(Continued)

*Primary Examiner* — Katherine Mitchell
*Assistant Examiner* — Johnnie A Shablack
(74) *Attorney, Agent, or Firm* — Factor Intellectual Property Law Group, Ltd.

(57) ABSTRACT

A wind lock for an overhead roll-up door, the wind lock having a first edge which is substantially straight and capable of extending substantially perpendicular vertically from a face of a door panel to which the wind lock attaches to, the wind lock including a second edge having an angled-beveled face, wherein the second edge extends at an angle from the first edge laterally across the face of an attached door panel is beveled with the face of the door panel so as to extend vertically from the face at an angle.

12 Claims, 8 Drawing Sheets

(56) References Cited

U.S. PATENT DOCUMENTS

| | | | | |
|---|---|---|---|---|
| 1,393,405 | A | 10/1921 | Soteros et al. | |
| 1,997,846 | A | 1/1933 | Armstrong | |
| 3,489,200 | A | 1/1970 | Recchione | |
| 3,796,010 | A | 3/1974 | Carlson | |
| 3,864,203 | A | 2/1975 | Marzocchi | |
| 4,357,978 | A | 11/1982 | Keller et al. | |
| 4,478,268 | A | 10/1984 | Palmer | |
| 4,601,320 | A | 7/1986 | Taylor | |
| 4,649,981 | A | 3/1987 | Bibeau | |
| 4,690,195 | A | 9/1987 | Taylor | |
| 4,987,943 | A | 1/1991 | Charest | |
| 5,131,450 | A | 7/1992 | Lichy | |
| 5,163,495 | A | 11/1992 | Lichy | |
| 5,170,833 | A | 12/1992 | Taylor et al. | |
| 5,172,744 | A | 12/1992 | Finch et al. | |
| 5,284,199 | A | 2/1994 | Finch et al. | |
| 5,351,742 | A | 10/1994 | Lichy | |
| 5,365,993 | A | 11/1994 | Jella | |
| 5,379,823 | A | 1/1995 | Kraeutler | |
| 5,392,836 | A | 2/1995 | West et al. | |
| 5,445,209 | A | 8/1995 | Lichy | |
| 5,482,104 | A | 1/1996 | Lichy | |
| 5,544,690 | A | 8/1996 | Magro et al. | |
| 5,657,805 | A | 8/1997 | Magro | |
| 5,964,270 | A | 10/1999 | Kirkey et al. | |
| 6,065,525 | A | 5/2000 | Wells | |
| 6,068,040 | A | 5/2000 | Magro et al. | |
| 6,152,208 | A | 11/2000 | Kalempa et al. | |
| 6,341,639 | B1 | 1/2002 | Mullet et al. | |
| 6,390,171 | B2 | 5/2002 | Drifka et al. | |
| 6,431,250 | B2 | 8/2002 | Mullet et al. | |
| 6,574,832 | B1 | 6/2003 | Boerger et al. | |
| 6,722,416 | B2 | 4/2004 | Varley et al. | |
| 6,942,003 | B2 | 9/2005 | Thompson | |
| 7,028,738 | B2 | 4/2006 | Ceccofiglio | |
| 7,131,481 | B2 | 11/2006 | Varley et al. | |
| 7,231,953 | B2 | 6/2007 | Varley et al. | |
| 7,275,581 | B2 | 10/2007 | Coenraets | |
| 7,464,743 | B1 | 12/2008 | Berger, Jr. | |
| 7,516,770 | B2 | 4/2009 | Jerry | |
| 7,581,578 | B2 | 9/2009 | Coenraets | |
| 7,748,431 | B2 | 7/2010 | Jansen et al. | |
| 7,793,702 | B2 | 9/2010 | Biewer et al. | |
| 7,841,377 | B2 | 11/2010 | Coenraets | |
| 8,109,317 | B2 | 2/2012 | Bostyn | |
| 8,291,960 | B2 | 10/2012 | Bowman | |
| 8,607,842 | B2 * | 12/2013 | Drifka | E06B 9/13 160/266 |
| 8,851,147 | B2 * | 10/2014 | Drifka | E06B 9/13 160/268.1 |
| 8,887,790 | B2 * | 11/2014 | Drifka | E06B 9/13 160/268.1 |
| 2005/0016695 | A1 | 1/2005 | Thompson | |
| 2005/0211391 | A1 | 9/2005 | Varley et al. | |
| 2006/0144530 | A1 | 7/2006 | Nagare et al. | |
| 2007/0131358 | A1 | 6/2007 | Iwasaki et al. | |
| 2008/0035282 | A1 | 2/2008 | Coenraets | |
| 2008/0093037 | A1 | 4/2008 | Kraeutler | |
| 2009/0145559 | A1 | 6/2009 | Glasl et al. | |
| 2010/0000692 | A1 | 1/2010 | Coenraets | |
| 2010/0288452 | A1 | 11/2010 | Coenraets | |
| 2010/0326607 | A1 | 12/2010 | Kitani et al. | |
| 2011/0259530 | A1 | 10/2011 | Brook et al. | |
| 2012/0241105 | A1 | 9/2012 | Drifka et al. | |
| 2012/0241110 | A1 | 9/2012 | Drifka et al. | |
| 2012/0325416 | A1 | 12/2012 | Hayashiguchi | |
| 2013/0061525 | A1 | 3/2013 | Drifka | |
| 2014/0158313 | A1 * | 6/2014 | McTavish | E06B 9/58 160/270 |
| 2015/0101765 | A1 * | 4/2015 | Drifka | E06B 9/13 160/270 |

FOREIGN PATENT DOCUMENTS

| | | |
|---|---|---|
| FR | 2 728 011 A1 | 6/1996 |
| GB | 2137271 | 10/1984 |
| WO | 03/106805 | 12/2003 |

OTHER PUBLICATIONS

Extended European Search Report for related EP App. No. 14737977 dated Jun. 24, 2016, 10 pages.

* cited by examiner

NINETY DEGREE WIND LOCK WITH BREAK-AWAY CAPABILITY AND DOOR PANEL AND DOOR ASSEMBLY UTILIZING THE SAME

RELATED APPLICATIONS

This application claims priority to U.S. Provisional Application Ser. No. 61/750,202 filed Jan. 8, 2013, the contents of which are fully incorporated herein by reference.

FIELD OF THE INVENTION

The present invention relates to overhead roll-up doors, and more specifically to door assembly, wind lock, and side column configurations for an overhead roll-up door.

BACKGROUND OF THE INVENTION

In some environments, overhead roll-up door assemblies, and in particular the door panels in the assemblies, are required to withstand great amounts of force and pressure resulting from environmental causes. For example, large differences or variations in air pressure on opposing sides of overhead roll-up door panels, or high winds directed at one side of a door panel, may cause a significant force to be imparted on one side of the door panel. In door assemblies which have large door panels, thousands of pounds of force due to wind and/or air pressure may be imparted on the door. These large forces may cause the door panel to unwantedly disengage from the door assembly and any side columns or guide tracks in which a portion of the door is positioned for travel, through the gap or opening which allows for the side columns to engage the door panel. Disengagement of the door panel may cause damage to the door and surrounding structures, may cause injuries to individuals proximate the door panel, and may prevent the door from properly operating and/or properly opening and blocking or closing the opening proximate the door.

Wind locks are an effective technique for keeping a flexible overhead roll-up door panel engaged within vertical side columns and guide tracks in high speed overhead roll-up door assemblies. There are different types of "wind locks" known within the industry, like, for example, rollers, buttons, and knobs. However, buttons and knobs, for example, fail to hold up to very large wind loads when used with large doors, or in the face of high winds or air pressure differentials as they tend to break off the door panel. Therefore, under these conditions, it is common to use a thick strip of rubber along the continuous vertical edges of the door panel to hold it within the side columns and guide tracks and prevent the door panel from "blowing out" while under a wind load.

Because the door panel and wind locks move vertically within and may engage the side columns as the door is opening and closing, it is desirable to move the door panel while generating as little friction as possible. Low friction between the wind locks and side columns permits a lower-powered HP motor to lift the door panel, and also allows the door panel to close completely (the door typically closes under its own weight) without stalling or binding up as the door panel is lowered in higher wind loads or greater air pressure differentials. Therefore, it is also common for the industry to overlap a thick rubber or similar wind lock with a low-friction fabric polyethylene terephthalate (PET) material, or the like.

In addition to combating wind loads, flexible overhead roll-up door panels must also be able to disengage when impacted with a transverse force by an object or vehicle passing proximate or through the door. Ideally, the door panels are capable of disengaging after impact without damaging the door assembly (panel, wind locks, side columns, motor) or any surrounding structures. In order to avoid such damage, it is common in the industry to use a 45 degree (or similarly angled) beveled inner surface on the wind lock and a mating 45 degree angled (or similarly complementary angled) engagement surface on the side column where the wind lock may engage or contact the side column with the door panel extending through a gap in the side column proximate the angled, mating surface. Utilizing a gap and mating angles may create a "wedge" effect as a portion or more the wind lock is pulled into and potentially through the gap in the side column. The wedge effect may allow the wind lock to compress and more easily slide or fit through a gap in the side column and "open" or expand the gap in the side column to allow the door panel to escape, instead of simply being pulled against the side column resulting in either the wind lock being ripped off, the panel being torn, or the side columns being bent or damaged during impact. The combination of the complementary angled faces on the wind lock and side column may also act to move or flex or rotate a portion of the side column to expand the gap in the side column to more easily allow the wind lock and door panel to escape. While this effect is desirable if the door panel is impacted or hit by an object, it is undesirable in response to a wind load being applied to the door panel.

Using continuous mating angles along the entirety of the door panel has a disadvantage—it may increase the friction between the wind lock and side column when the door is opening or closing. Under wind loads or when an air pressure differential exists, the door panel may "bow out." The bowing of the door panel may pull the wind locks inward, towards the center of the opening or door panel, causing the wind locks to engage the side columns, or more problematically become wedged in the side column gaps, as the door panel is opening or closing. For example, the mating angled surfaces of the wind locks and side columns can result in the overall increase in friction. This may create wear on the wind locks, door panel, and side columns, and puts unwanted stress on the motor controlling the operation of the door panel. When under a high wind load, these wind locks may also become stuck in the gap and side column, causing the door panel to stick, potentially damaging the door panel, the wind locks, and the motor.

Therefore, it would be advantageous to design a wind lock, door panel, side column and overall door assembly which eliminates the use of continuous mating 45 degree or similarly complementary angles in the wind lock and side column to substantially lower friction and enhance satisfactory wind load response, while at the same time maintaining or enhancing a satisfactory wind load response and the disengageability of the door panel if the door panel is impacted with a transverse force.

The present invention is provided to solve these and other problems.

SUMMARY OF THE INVENTION

The present invention is directed to providing an overhead roll-up door having a better wind lock which provides proper support in the face of wind loads while substantially reducing friction in known door assemblies. The wind lock of the present invention will still allow an associated door panel to disengage from the assembly if impacted by a transverse force from an object or vehicle traveling proximate the door panel. In order to accomplish this goal, the door assembly, door panel, and wind lock in the present disclosure eliminates the traditional continuous 45 degree bevel and mating side column angle proximate a side column gap with a wind lock and side column having mating 90 degree faces or edges. It has been found by the inventors of this application that this configuration maintains a satisfactory wind load response while substantially reducing, if not eliminating, a multiplication factor for overall friction of the 45 degree bevel and mating side column configuration known in the prior art.

The disclosure herein provides a door assembly and wind lock having the low-friction benefits of the 90 degree surfaces, but also which may be "broken away" without damaging the door panel, wind lock, side columns, or any surrounding structures if the door panel is impacted. In order to insure that the door panel and wind lock can escape the side column when the door panel is impacted by a transverse force, the wind lock may include a compound or angled beveled edge at the lower end or towards the bottom of the door panel. The compound beveled wind lock may be, for example, a 60 degree angle from the bottom of the door panel with about a 30 degree bevel.

According to one aspect of the invention, a wind lock for an overhead roll-up door is provided. The wind lock includes a first edge, the first edge being substantially straight and being capable of extending substantially perpendicular vertically from a face of a door panel to which the wind lock may attach to. The wind lock includes a second edge which has an angled face which is beveled with, or extends at an angle vertically from, the face of the door panel. The second edge may extend at an angle from the first edge.

The wind lock may be made of rubber and may also include an outer edge, the outer edge being spaced apart from and located opposite the first edge. The second edge may extend horizontally at an angle to the first edge, extending between the first edge and the outer edge of the wind lock.

According to one aspect of the intention, a door panel for an overhead roll-up door assembly is provided. The door panel includes a top edge, a bottom edge, opposing vertical side edges, a first face, a second face, and at least one wind lock. The at least one wind lock may be attached to the door panel proximate one of the opposing vertical edges. The at least one wind lock may have a first portion having a first edge and a second portion having a second edge, wherein the first edge extends vertically, substantially perpendicular from the first or second face of the door panel, and is located a first distance from the opposing vertical edge proximate the at least one wind lock. The second edge may be beveled such that it extends vertically from the first or second face of the door panel at an angle to the door panel.

The second portion and the second edge may extend laterally across the first or second face of the door panel at an angle to the first edge. For example, the second edge may begin proximate the first edge of the wind lock and be angled outward, towards the opposing vertical edge proximate the at least one wind lock. In this configuration the second portion may begin proximate the first edge and terminate close to the opposing vertical edge of the door panel proximate the wind lock.

The at least one wind lock may also include an exterior edge opposite the first edge. The exterior edge may be positioned closer to, and in some cases may substantially align with, the opposing vertical edge proximate the at least one wind lock. The exterior edge may extend vertically from the first or second face of the door panel. The second edge of the wind lock may then extend laterally across the first or second face of the door panel from the first edge to the exterior edge at an angle to the bottom edge of the door panel. The angle may be 60 degrees or the like.

The at least one wind lock may also include a top face extending substantially parallel to the door panel between a top edge or portion of the first edge and a top edge or portion of the exterior edge. At least a portion of the door panel located proximate the first edge, the first edge, and the top face of the wind lock may be covered in a friction reducing material like, for example, PET.

Regardless of the configuration, the second edge may be beveled so as to extend vertically from the first or second face of the door panel at an angle of 30 degrees to the first or second face of the door panel.

The door panel may further include at least a second wind lock, the second wind lock being attached proximate the opposing vertical edge opposite that to which the at least one or first wind lock is attached. The second wind lock may be constructed and positioned substantially similar to the first or at least one wind lock with a first portion having a first edge and a second portion having a second edge. The first edge of the second wind lock may extend vertically, substantially perpendicular from the first or second face of the door panel and be located a distance from the opposing vertical edge proximate the second wind lock. The second wind lock may also include a second edge which is beveled such that it extends vertically from the first or second face of the door panel at an angle to the door panel.

According to one aspect of the invention, a side column for an overhead roll-up door is provided. The side column includes a base portion and an outer cover portion. The outer cover portion may have a parallel portion and a perpendicular portion. The parallel portion may be substantially parallel to, and spaced apart from, the base portion a first distance so that the parallel portion and base portion at least partially define an area. The area between the parallel portion and the base portion at least partially defines a vertical channel for receiving and engaging a portion of, and guiding, a door panel and any attached wind locks used in conjunction with the side column. The perpendicular portion may extend substantially perpendicular from the parallel portion in a direction towards the base portion. The perpendicular portion may terminate before extending to the base portion so that a gap extending a second distance, between an end of the perpendicular portion and the base portion exists. This gap may be less than the first distance between the parallel portion and the base portion.

The side column may include a guard piece operably attached to the perpendicular portion proximate the gap between the perpendicular portion and the base portion.

In order to attach the outer cover portion to the remainder of the side column, it is contemplated that the side column may include an attachment element, like for example a mounting bolt, which operably attaches the parallel portion to the side column. A resilient member may be operably connected to the side column by the attachment member. The outer cover portion may be able to compress the resilient member to pivot or rotate the outer cover portion outwards to expand the gap. The resiliency of the resilient member will force the outer cover portion to return to a closed position, re-establishing the gap at the second distance, once any need for an increased or expanded gap is removed.

According to one aspect of the invention, an overhead roll-up door assembly for selectively opening and closing an opening bounded by a top, a bottom, and opposing sides is provided. The overhead roll-up door assembly includes a door panel having a top edge, a bottom edge, a first face, a second face, and opposing vertical edges. At least two wind locks are attached to the door panel, each wind lock having a thickness and being attached proximate one of the opposing vertical edges. Each wind lock further includes a first portion having a first edge and a second portion having a second edge. The first edge extends substantially perpendicular vertically from the first or second face of the door panel when the wind lock is attached thereto and is located a distance from the opposing vertical edge proximate each respective wind lock. The second edge is beveled such that it extends vertically from the first or second face of the door panel at an angle to the door panel. The door assembly also includes at least two side columns positioned on opposite sides of the opening such that one side column is proximate each opposing side of the opening. Each side column has a base portion and an outer cover portion, with each outer cover portion having a parallel portion and a perpendicular portion. Each parallel portion is substantially parallel to, and spaced apart from, its respective base portion a first distance, defining an area between there between. The area defined between the parallel portion and the base portion at least partially defines a vertical channel in each side column for engaging and guiding the door panel and the attached wind locks as the door panel is opened and closed. Each perpendicular portion extends substantially perpendicular from the respective parallel portion in a direction towards the respective base portion. Each perpendicular portion terminates before extending to the respective base portion so a gap extending a second distance between an end of each perpendicular portion and the respective base portion is formed. The second distance or gap is less than the first distance between the respective parallel portion and the respective base portion. The combined thickness of each wind lock and the door panel is also greater than the second distance or gap in each side column. The perpendicular portion of each of the respective side columns may engage one of the at least two wind locks when a wind load is applied to the door panel to prevent the door panel from escaping the vertical channel in each side column.

The second edge of each wind lock may extend laterally across the first or second face of the door panel at an angle to each respective first edge. For example, each second edge may extend laterally outward across the first or second face of the door panel at an angle to each respective first edge, beginning proximate each respective first edge and terminating closer to each respective opposing vertical edge proximate each wind lock than the respective first edge.

Each wind lock may include an exterior edge opposite each respective first edge. Each exterior edge may be positioned closer than each respective first edge to, or even substantially aligned with, the opposing vertical edge proximate each respective wind lock. The exterior edge may extend vertically from the first or second face of the door panel. Each second edge may then extend laterally across the first or second face of the door panel from the respective first edge to the respective exterior edge at an angle of 60 degrees to the bottom edge of the door panel.

Each wind lock may also include a top face which extends substantially parallel to the first or second face of the door panel between a top edge or portion of the first edge and a top edge or portion of the exterior edge. At least a portion of the door panel located proximate the first edge, the first edge, and the top face may be covered in friction reducing material such as PET fabric.

In the overhead roll-up door assembly, each side column may also have a guard piece operably attached to the perpendicular portion proximate the gap between the perpendicular portion and the base portion. The guard piece may be configured to engage each respective wind lock when a wind load is applied to the door panel.

Each side column may include an attachment member, like for example a mounting bolt, for operably attaching the respective outer cover portion to each respective side column. Each side column may further include a resilient member, like for example a metal or rubber washer, operably connected to each side column by the respective mounting bolt. Each resilient member may allow the outer cover portion of each side column to rotate and expand the gap in response to a large force being applied to the outer cover portion resulting from the door panel being impacted by an object or vehicle. The resilient member held against the outer cover portion of each side column will allow an engaged wind lock and vertical edge to pivot or rotate the outer cover portion of the side column so that the engaged wind lock and vertical edge may escape the side column when a transverse force impacts the door panel. The second edge of each wind lock will be configured to engage the side column in a manner which allows it to pass through and expand the gap in each respective side column by rotating the cover portion of the respective side column. The resilient member may compress and deform, allowing the cover portion to further rotate and allow the first portion and first edge to escape the side column as well. Once the door panel and wind lock have passed completely through the gap and out of the side column, the resilient member may then cause the outer cover portion to rotate back into position, re-establishing the gap at the second distance.

Additional features, advantages, and embodiments of the invention may be set forth or apparent from consideration of the detailed description and drawings. Moreover, it is to be understood that the foregoing summary of the invention and the following detailed description, drawings and attachment are exemplary and intended to provide further explanation without limiting the scope of the invention as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1:
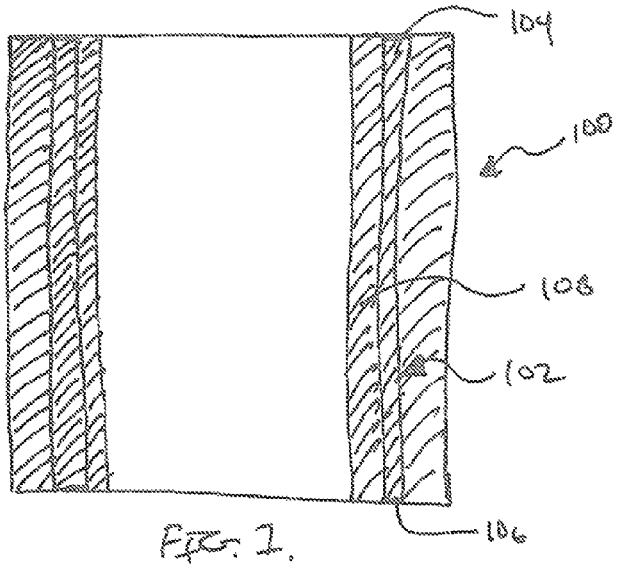
FIG. 1. PRIOR ART
FIG. 1 is an example of a door panel and wind lock configuration of the prior art.

The present disclosure is further described in the detailed description that follows.

DETAILED DESCRIPTION OF THE INVENTION

The disclosure and the various features and advantageous details thereof are explained more fully with reference to the non-limiting embodiments and examples that are described and/or illustrated in the accompanying drawings and detailed in the following description. It should be noted that the features illustrated in the drawings are not drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the invention may be practiced and to further enable those of skill in the art to practice the examples of the disclosure. Accordingly, the examples and embodiments herein should not be construed as limiting the scope of the invention.

Figure 3:
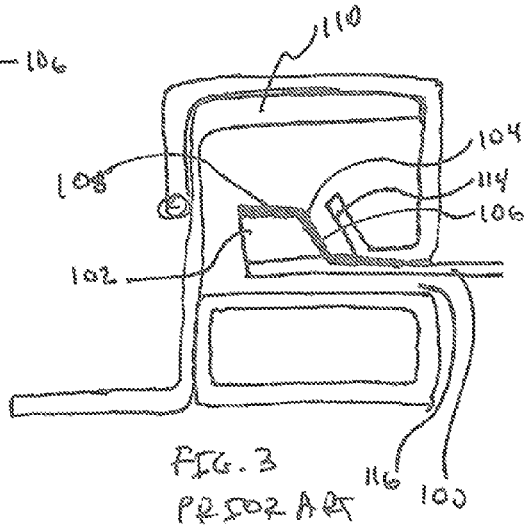
FIG. 3 PRIOR ART
FIG. 3 is a cross section along line X-X in FIG. 2 showing a door panel and wind lock configuration engaged in a side column, according to the prior art.
Figure 2:
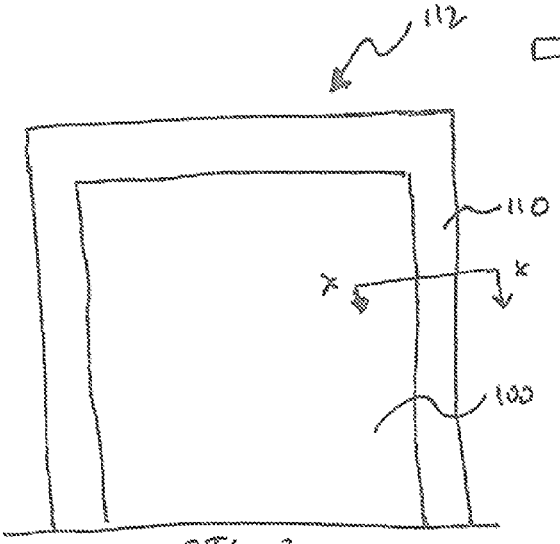
FIG. 2 PRIOR ART
FIG. 2 is an example of a door assembly according to the prior art.

FIGS. 1-3 are illustrations of a flexible overhead roll-up door panels and assemblies having a wind lock and mating side column as is known in the prior art. As seen in FIG. 1, overhead roll-up door panel 100 includes wind lock 102 which has an inner facing portion 104 which is beveled with face 106, extending vertically from the door panel at an angle. On most known door panels, this angle is approximately 45 degrees or the like.

As seen in FIG. 1, a strip of PET fabric 108 may be adhered to, and used to cover a portion or all of the wind lock and a portion of the door panel proximate the wind lock. This strip of PET fabric may help to protect the wind lock and door panel, and help reduce friction, when the door panel is utilized in a door assembly and engaged with a vertical side column as shown in FIGS. 2 and 3. As seen in FIG. 3, which is a cross-section of door panel 100 and vertical side column 110 of door assembly 112 from FIG. 2 taken along the line X-X, when engaged and being guided within a side column, the inner angled face of the wind lock may engage a cooperatively angled portion 114 of the side column to maintain engagement and guidance of the door panel with the side column and door assembly. The remainder of the door panel passes through side column gap 116 and into and across the opening. The cooperatively angled portion will help maintain alignment of the door panel when a wind load is applied to the door, but will allow the wind lock to escape the side column if the door panel is impacted by a vehicle or the like.

While the angled inner face and cooperatively angled side column may be effective in maintaining alignment of the door panel while also allowing for it to disengage if the door panel is impacted, the angled portion has multiple disadvantages. As the panel "bows out" due to the catenary effect when a wind load is applied to the door panel, see for e.g. FIGS. 15 and 16 discussed herein, the wind locks are drawn inward, towards the opening, and are pressed against or engaged with the side columns. Specifically, under a wind load, the angled portions, and in particular the angled inner face of the wind lock, engages the side column, effectively creating a "wedge" effect where the angled inner faces become pulled into and wedged within the side column gap, substantially increasing the frictional forces on the wind lock and door panel. This increases the strain on the motor and potential for damage to the door panel, wind lock, door assembly, and motor. The use of the cooperatively angled wind lock and side column, and any potential wedge effect realized when using the same, may cause the overall friction of the system to be about 2.41 times higher than the friction created by the same materials on flat surfaces.

The present invention is aimed to provide an improved wind lock system by eliminating the traditional 45 degree bevel along the entire length of the wind lock, and utilizes low-friction I high-wind load aspects of a 90 degree or perpendicular face along a substantial portion of the length of the wind lock (and along the outer vertical edges of the panel). This configuration at least substantially eliminates the 2.41 multiplication factor mentioned above. Moreover, a compound bevel angle may be provided at the lower end of the wind lock to allow for the wind lock and associated door panel to break-away should it be impacted. By beveling the bottom of the wind lock and utilizing a flexible side column cover, the door panel may break-away without having to re-attach or replace components, and eliminate any possible wedge effect resulting from a completely beveled wind lock becoming locked or wedged in the side column during vertical movement.

Figure 4:
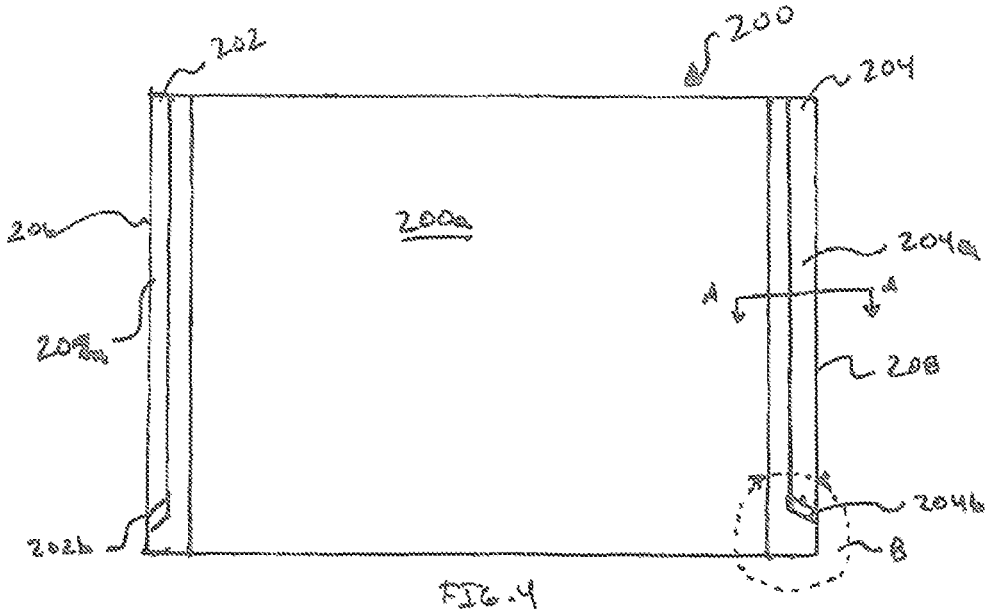
FIG. 4 is an example of a door panel and wind lock configuration in accordance with the present invention.

FIG. 4 shows an embodiment of a door panel as contemplated by the invention. Door panel 200 includes two wind locks 202, 204 attached to a first face of the door panel, with one wind lock being positioned proximate each of the opposing vertical edges 206, 208 of door panel 200. Each of the wind locks 202, 204 include a first portion 202*a*, 204*a*, which includes a substantially straight or first edge which extends at 90 degrees or perpendicularly from the door panel, and a second portion 202*b*, 204*b*, which includes a second edge that is beveled with the door panel. The second portion extends outward from the first portion towards the opposing vertical edge proximate the wind lock. As seen in FIG. 4, wind locks 202, 204 attach to first face 200*a* of door panel 200, however it is contemplated that the wind locks may attach to second face 200*b* identified, for example, in FIG. 5. A strip of wear and friction reducing fabric may be used to cover the top face or portion of each wind lock 202, 204. The strip of wear and friction reducing fabric may be extended to cover portion of the first edge of the wind lock and/or to cover a portion of the first face 200*a* of the door panel proximate each of the wind locks 202, 204. Rather than a single strip of wear and friction reducing fabric covering each of these portions, separate strips of fabric may be used to cover the top face or portion, the straight or first edge, and the portion of the door panel proximate the wind lock.

Figure 5:
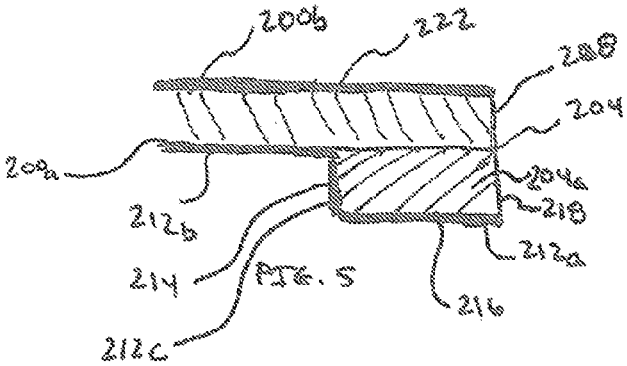
FIG. 5 is an example of a cross-section of a wind lock and door panel taken along the line A-A in FIG. 4.

FIG. 5 is a detailed cross-sectional view of FIG. 4 taken along the line A-A in FIG. 4 which better shows the shape of the first portion 204*a* of the wind lock 204 and fabric strip 212 (212*a-c*). Wind lock 202 may be a mirror image of wind lock 204, just on the opposite side of the door panel. As seen in FIG. 5, wind lock 204 includes a first edge 214, a top face 216, and an outer edge 218 positioned proximate outer vertical edge 208 of door panel 200. In some embodiments outer edge 218 may substantially align with outer vertical edge 208 of door panel in 200, while in embodiments outer edge 218 may be slightly offset or set inside the outer vertical edge of the door panel. Regardless, outer edge 218 will be positioned closer to outer vertical edge 208 of door panel 200 than first edge 214.

First edge 214 extends substantially perpendicular from one face (shown as 200*a*) of the door panel 200. Top face 216 is covered by wear and friction reducing strip of fabric 212*a*, while door panel 200, proximate wind lock 204, may be covered in a strip of wear or friction reducing fabric 212*b*. First edge 214 may also be covered in a strip of wear reducing fabric 212*c*. As seen in FIG. 5, an additional strip of wear and friction reducing fabric 222 may be adhered to door panel on the face opposite that to which wind lock 204 attaches, i.e. second face 200*b*, in order to protect the opposing face of the door panel from damage resulting from direct contact with the side column.

Figure 6:
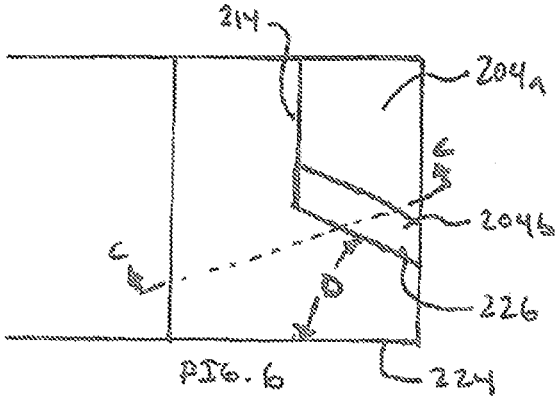
FIG. 6 is a close up of portion B of the wind lock and door panel in FIG. 4.

FIG. 6 shows portion B of FIG. 4, better showing second portion 204*b* of the wind lock 204. In this example, the second portion 204*b* is configured to extend at an angle from first portion 204*a* and the first edge 214. 204*b* may, for example, extend at an angle from portion 204*a* and first edge 214 in a manner such that portion 204*b* forms an angle D with the lower edge 224 of door panel 200. Preferably, angle D is approximately 60 degrees or a similar angle which will keep the angled-beveled or second edge 226 from engaging any side column when a wind load is applied to the door panel. With substantial impact, and as the door panel is significantly bowed, like for example when the bottom of the door panel is impacted, the angled-beveled portion may engage any side column to escape.

Figure 7:
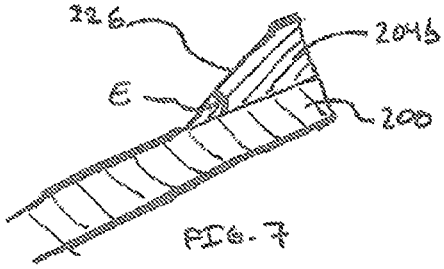
FIG. 7 is an example of a cross-section of a wind lock and door panel taken along the line C-C in FIG. 6.

FIG. 7 is a detailed cross-sectional view taken along line C-C of FIG. 6. FIG. 7 shows that portion 204*b* and second edge 226 of wind lock 204 may also be beveled, rising at an angle E from the face of the door panel. This angle may be about 30 degrees from the face as shown, in order to create a wedge which may more easily engage and escape any engaged side column if the door panel is impacted, and further facilitate the movement of the side column to better allow first portion of the wind lock to escape the side column as well. Different angles with respect to the bottom of the door, or different rise angles for the beveled face may be used to make it easier to break away and escape an associated side column (for small doors with low wind loads, or customers with a lot of traffic), or make it more difficult to break way and escape an associated side column (for larger doors with high wind loads, or customers without much traffic).

Figure 8:
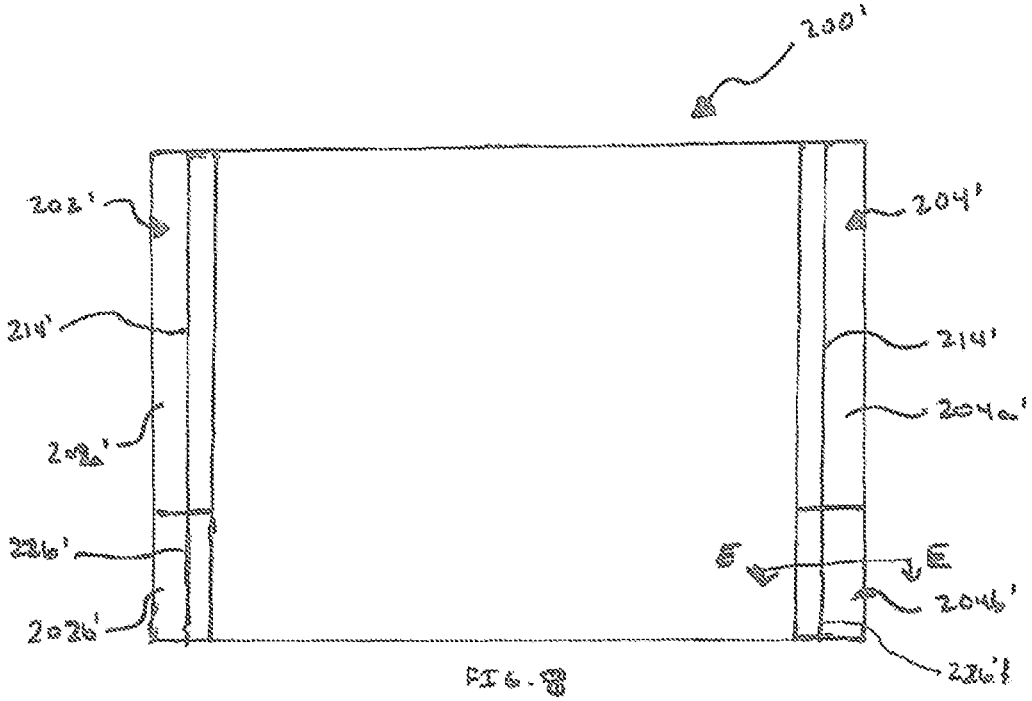
FIG. 8 is an example of a door panel and wind lock configuration in accordance with the present invention.
Figure 9:
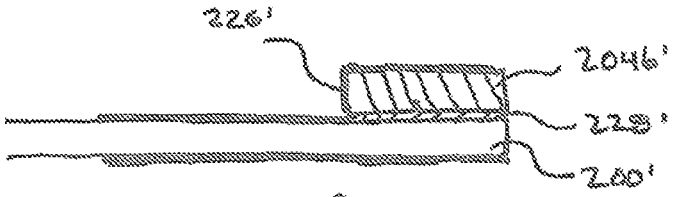
FIG. 9 shows a cross-section along line E-E in FIG. 8.

FIGS. 8 and 9 show an alternative embodiment of the present invention wherein both wind locks 202',204' are entirely straight or perpendicular to the face of door panel 200'. As seen in FIGS. 8 and 9, first portion 204*a*' and first edge 214' is substantially aligned with second portion 204*b*' and second edge 226' along a first face of the door panel. In order to facilitate the escape of the door panel after an impact, second portion 204*b*' may be a "tear-away" portion attached to the door panel in a manner which will allow it to tear away under significant force to allow the door panel to escape an engaged side column and prevent damage to the second portion of the wind lock, the door panel, an associated side column, and other components of an associated door assembly. In such embodiments, it is contemplated that second portion 204*b*' may be a 3 ft. long "tear-away" bottom section of wind lock that would need to be replaced if it became disengaged due to an impact. For example, second portion 204*b*' may be attached by Velcro® 228' or plastic fasteners or snaps 228' as seen in FIG. 9 which is a cross-section along the line E-E in FIG. 8.

Figure 10:
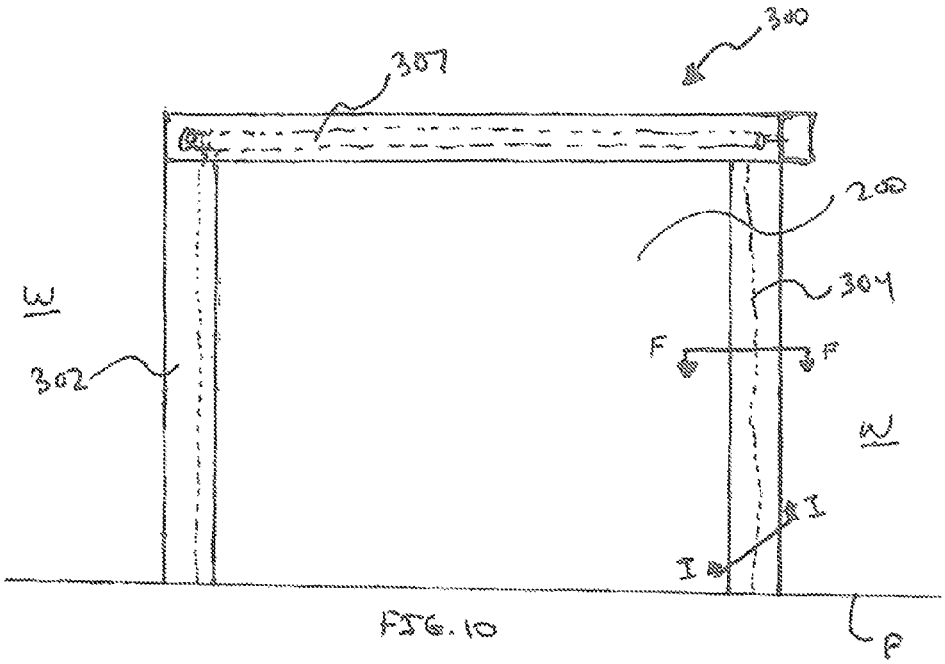
FIG. 10 shows an example of a door assembly as contemplated by the present invention.

FIG. 10 shows door panel 200 installed into door assembly 300 which includes side columns 302, 304 which may be disposed at opposite sides of an opening which is selectively opened and closed by door panel 200. As seen in FIG. 10, the door panel extends into the side columns on either side, where the door panel will be guided and engaged as the door panel is raised and lowered unless the door panel is impacted by a force from a vehicle or the like. The opening, which may be located behind the door panel, may be bounded by walls W and floor F and opened and closed as door panel 200 is wound and unwound from drum 305. Drum 305 may be controlled by at least one motor which may control the drum and operation of the door panel based upon control signals received from a door controller which may be manually or automatically activated when the door panel requires opening or closing.

Figure 11:
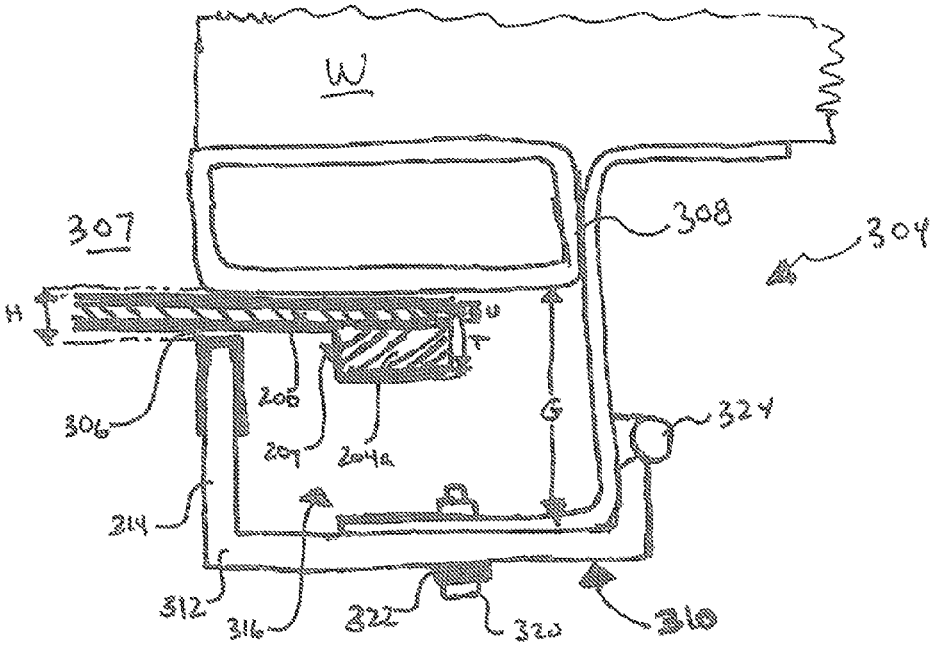
FIG. 11 is a cross-section along the line F-F in FIG. 10 when the door panel is under normal conditions.

In order to better see the construction of the side columns and how the door panel and wind lock engages and travels and rests within the side column under normal conditions, FIG. 11 shows a cross-section along line F-F in FIG. 10 when no, or a very small, wind load is applied to the door panel. As with describing door panel 200 above, side columns 302, 304, and the engagement between the side columns and door panel 200, are substantially identical, and as such, the description herein for the engagement between side column 304 and door panel 200 and wind lock 204 is likewise applicable to side column 302, door panel 200 and wind lock 202.

As seen in FIG. 11, door panel 200 extends through gap 306 in side column 304 to block opening 307 located substantially behind the door panel and inside of the side column and walls. Wind lock 204 is positioned inside of side column 304 with first portion 204*a* being substantially unengaged with any portion of the side column when no wind load or impact force is applied to door panel 200.

As seen in FIG. 11, side column 304 may include a base portion 308 and an outer cover portion 310 which forms the front of the side columns. Outer cover portion 310 includes a parallel portion 312 and a perpendicular portion 314. When unengaged with the door panel, parallel portion 312 extends substantially parallel to base portion 308 and is spaced apart therefrom a first distance G, forming vertical channel 316 in which door panel 200 and wind lock 204 are engaged and guided during door travel, or when the door panel is partially or substantially closed.

Perpendicular portion 314 of outer cover portion 310 extends substantially perpendicular from parallel portion 312, in a direction towards base portion 308. The perpendicular portion terminates prior to reaching the base portion so that gap 306 is formed between the perpendicular portion and the base portion. Gap 306 should extend a second distance H, which is less than both distance G, and the thickness T of the body of the door panel and wind lock 204. Gap 306 should, however, be greater than the thickness U of the body of the door panel 200. Configuring gap 306 in this manner allows for door panel 200 to extend through the gap, and easily travel and be guided up and down as the door is opened and closed without engaging the side column, while also preventing wind lock 204 from escaping side column 304 under normal or wind load conditions.

Figure 12:
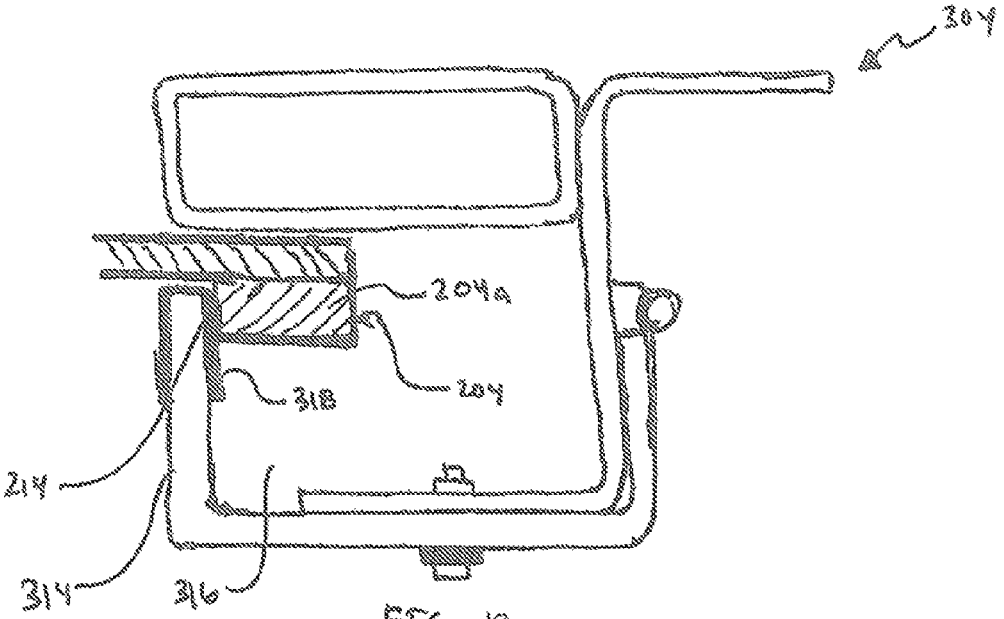
FIG. 12 is a cross-section along the line F-F in FIG. 10 when a wind load is applied to the door panel.

FIG. 12 is again a cross-section along the line F-F and shows the engagement between door panel 200 and wind lock 204 and first edge 214 and side column 304 and perpendicular portion 314 when a wind load is applied to the door panel. As seen in FIG. 12, when a wind load is applied to door panel 200, wind lock 204 is pulled inwards causing door panel 200 to bow (see FIGS. 15 and 16 herein for an overhead view of this effect), causing portion 204*a* and first edge 214 of wind lock 204 to engage perpendicular portion 314. This engagement prevents the door panel and wind lock from escaping vertical channel 316. In order to protect the door panel and wind lock, guard piece 318 may be placed over the edges of the perpendicular portion where the door panel and wind lock may come into contact with the side column. Guard piece 318 may have a lower coefficient of friction than the side columns, and may provide cushioning and protection from damage caused by any edges or corners associated with the perpendicular portion. Guard piece 318 may be constructed from fabric or plastics for example, and may be treated with any chemical or composition which further reduces the friction coefficient of the material.

When a wind load is applied to door panel 200, first portion 204*a* of wind lock 204 engages side column 304 and perpendicular portion 314. Since a wind load or pressure differential is typically uniformly applied to the door panel, second portion 204*b* of the wind lock will not engage the side column perpendicular portion as it is angled away from the edge of first portion 204*a* in a manner which prevents engagement, which substantially prevents second portion 204*b* and second edge 226 from contacting side column 304 and wedging in gap 306 as the door panel opens and closes. This allows the door panel to open and close with significantly reduced friction from prior art door panels and wind locks as the wedge effect is substantially limited because of the outward angling of the second portion 204*b*.

However, having an angled-beveled or second portion will provide the door panel with the ability to disengage if the door is impacted by a vehicle or other object attempting to travel through or proximate opening 308, particularly if the portion of the door panel proximate the angled beveled portion is impacted. An impact force, unlike a wind load or air pressure differential, is generally concentrated at a particular place on the door panel. At that location, the door panel will receive a significant force, causing significant bowing at that location, causing the portion of the wind lock at that location to be pulled into engagement with the side column. Placing the second or beveled portion of the wind lock proximate the bottom of the door panel, rather than in the middle or at the top better increases the disengage-ability of the door panel and wind lock, as most impacts occur proximate the bottom of the door panel as a vehicle or the like tries to sneak under a closing door or approaches an opening door too fast. Placing the second or beveled portion proximate the bottom of the door panel allows for the beveled portion to engage the side column when the door panel is impacted, allowing the beveled portion to push through and open the gap in the side column so that the entire wind lock and door panel can more easily escape the side column.

Figure 14:
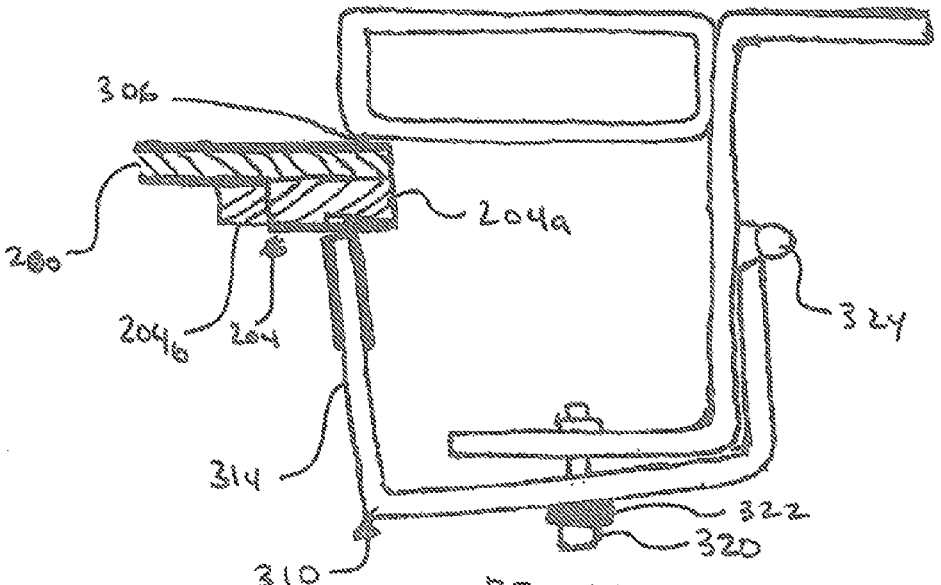
FIG. 14 is a cross-section along line F-F in FIG. 10 showing a portion of the wind lock disengaging from the side column after the door panel has been impacted by a transverse force.
Figure 13:
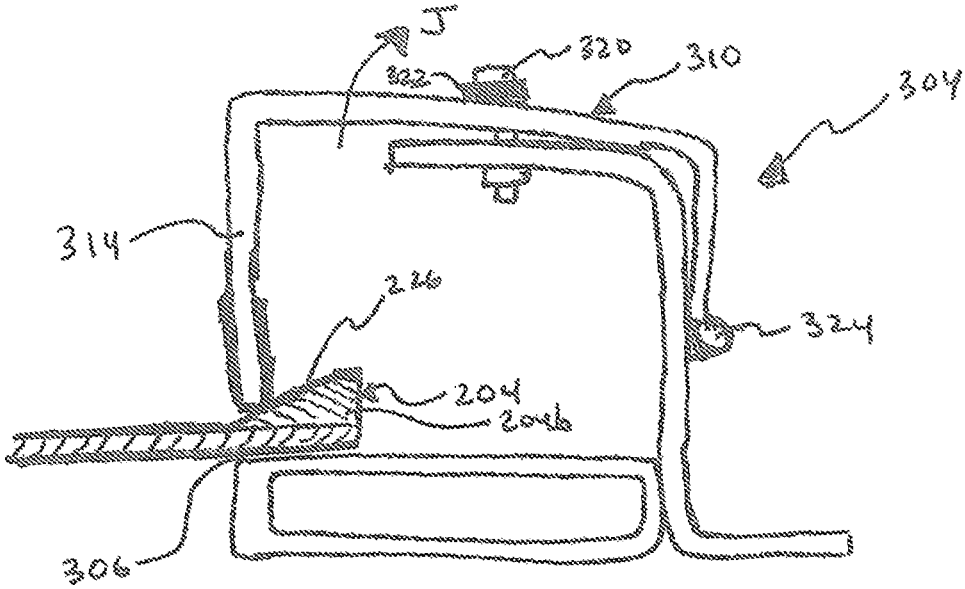
FIG. 13 is a cross-section along the line I-I in FIG. 10 showing a portion of the wind lock disengaging from the side column after the door panel has been impacted by a transverse force.

FIGS. 13 and 14 show engagement between side column 304 and door panel 200 and wind lock 204 when the door panel is impacted by a transverse force, like for example, impacted by a moving vehicle or the like. FIG. 13 shows the engagement of second portion 204*b* and second edge 226 with the perpendicular portion taken along the line I-I, for example, in FIG. 10. As seen in FIG. 13, when door panel 200 is impacted, the significant force on the door panel will cause second edge 226 of second portion 204*b* to be pulled into contact with perpendicular portion 314 of side column 304. This force and the resulting contact will cause the second portion to move into gap 306, and begin opening side column 304 by causing outer cover portion 310 to move or rotate in direction J, widening the gap so that the remainder of wind lock 204 can pass through and further increase the gap, and door panel 200 can escape.

In order to allow for the gap to expand and side column 304 to be opened, the side column may include mounting bolt 320, resilient member 322, and pivot point 324, all of which act to connect and hold outer cover portion 310 in place, while also allowing it to open and pivot and move when necessary.

As seen in FIG. 13, when second edge 226 of second portion 204*b* of wind lock 204 engages perpendicular portion 314, resilient member 322 which is held in place by bolt 320 will begin to compress and cover portion 310 will begin rotating in direction J about pivot point 324, effectively expanding gap 306. Gap 306 will continue to widen as second portion 204*b* passes through the gap, until gap 306 is wide enough so that first portion 204*a* of the wind lock may begin passing through the gap (see FIG. 14). Once first portion 204*a* has passed completely through the gap, bolt 320 and resilient member 322 will cause the side column to close and revert to its original form, as seen in, for example, FIGS. 11 and 12.

Resilient member 322 may be a compression or washer spring which is compressible and has a resiliency which allows the washer, and in turn outer cover portion 310, to remain in place until an impact force great enough to compress the washer is impacted on the door panel. The resiliency will also allow the cover to return to the normal, resting, unengaged position once the wind lock has passed there through. In order to provide more or less resiliency, washer 322 may be replaced with a thicker or thinner, or more or less resilient, washer. Increasing or decreasing the resiliency will allow outer cover portion 310 to pivot open under higher or lower forces respectively, which will allow door panel 200 to escape less or more easily. For example, in environments where wind load is generally minimal but traffic proximate the door panel is very high, rubber washers of varying thicknesses may be utilized. Rubber washers tend to have substantial amounts of give which allow for the side column to deform or open more easily when force is applied from the door panel and wind lock resulting from an impact on the door panel. However, in environments which have high wind loads, the use of a rubber washer may not be ideal as a rubber washer may have too much give and may allow a door panel to escape as a result of the force imparted on the side column by the door panel and wind lock because of a wind load. In these environments, a steel washer or the like may be beneficial as it provides more rigidity to prevent the side column from deforming from resulting forces. While a steel washer may provide more rigidity in the face of wind loads, a steel washer will still allow the side column to deform and the outer cover portion of the side column to rotate as a result of forces occurring because of an impact on the door panel. Alternatively, rather than adjust the washer size or resiliency, the resiliency of the washer may be adjusted by loosening or tightening bolt 320.

Pivot point 324 may be a simple hinge, a ball/joint or similar pivoting element, or may alternatively be a spring hinge or the like to provide additional support or resiliency to outer cover portion 310. So long as outer cover portion 310 may open and close at pivot point 324, any combination or element known in the art may be used.

Figure 15:
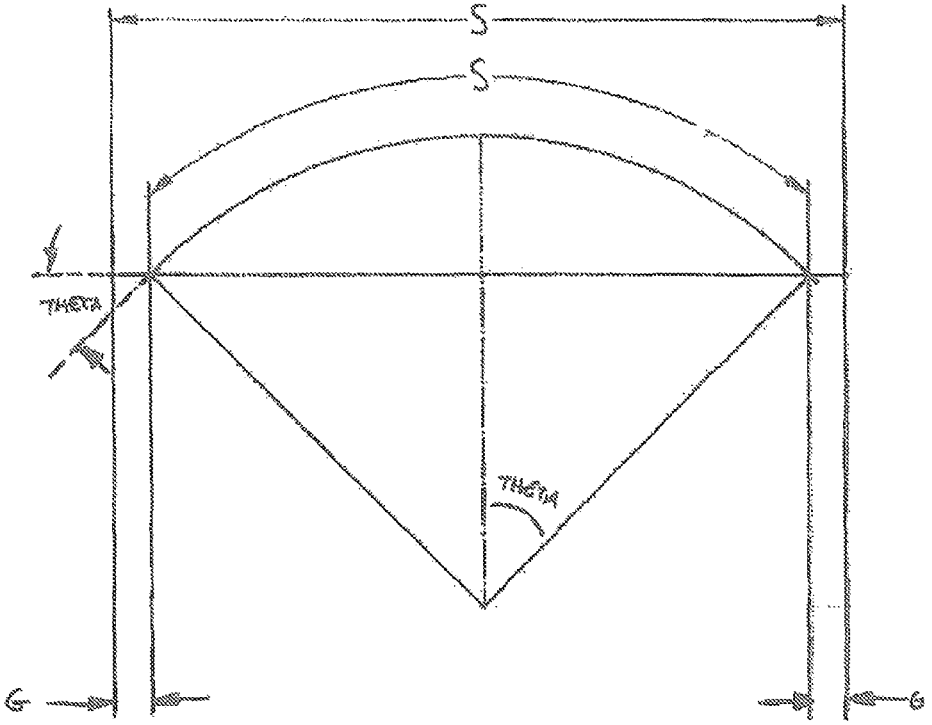
FIG. 15 shows a top view of a door panel having a wind load applied thereto.
Figure 16:
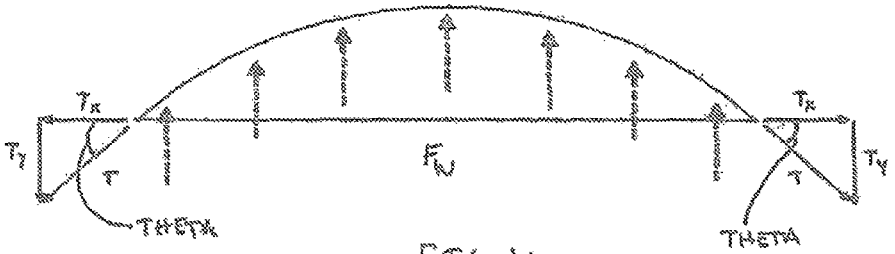
FIG. 16 shows a top view of a door panel having a wind load applied thereto.

FIGS. 15 and 16 show an example of a door panel having a wind load applied to it and the resulting bow effect. The door panels shown in FIGS. 15 and 16 may be exemplary for any overhead roll up door panel known in the art and are not limited by the wind locks or side column configuration of any specific door panel or door assembly. As seen in these Figs., as a wind load is applied to an overhead roll up door panel, the door panel bows, causing the edge of the door and any accompanying wind lock to be pulled into engagement with an associated side column. This may be known as the cantenary effect. The cantenary angle (for example THETA in FIGS. 15 and 16) produced a wind load can be calculated and used to determine the tension or force created by the wind lock engagement.

The cantenary angle THETA in FIGS. 15 and 16 may be calculated as follows:

$$\text{THETA}=A\ \text{SIN}(C/2R)$$

$$C=S-2G$$

$S$=total panel width $G$=gap between the windlock and side column before engagement $$R=(C^2/4+H^2)/2H$$

$$H\sim(3/16*(S^2-C^2)^{0.5}$$

The tension T in the door panel due to the cantenary effect can be found by determining the forces applied on the panel in both the x- and y-directions as shown in FIG. 16. The forces in the y-direction as shown are simple:

$$2Ty=Fw=\text{Wind Load}$$

$$Ty=Fw/2$$

where Ty is the tension in the y-direction on the door panel and Fw is the force of the wind on the door panel. In order to determine the tension T in the door panel as shown, the Ty may be used:

$$T=Ty/\sin(\text{THETA})$$

Substituting the value of Ty into the equation provides:

$$T=Fw/2\ \sin(\text{THETA})$$

The tension in the x-direction (the value of Tx) as shown can likewise be found using the value of Ty:

$$Tx=Ty/\tan(\text{THETA})$$

$$Tx=FW/2\ \tan(\text{THETA})$$

Figure 17:
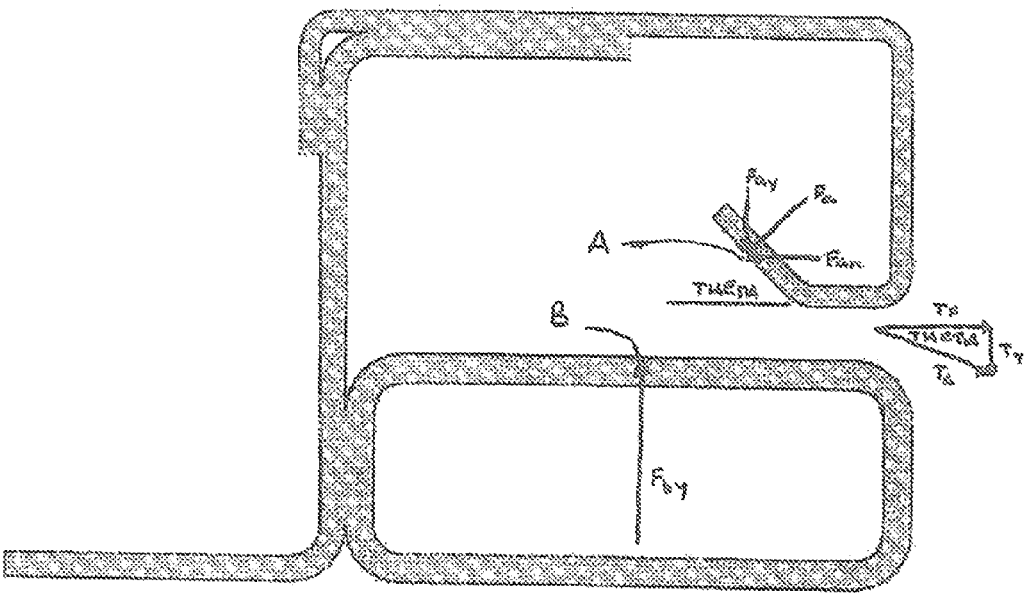
FIG. 17 PRIOR ART
FIG. 17 shows a prior art side column and the resulting forces from an engaged wind lock in the prior art.
Figure 18:
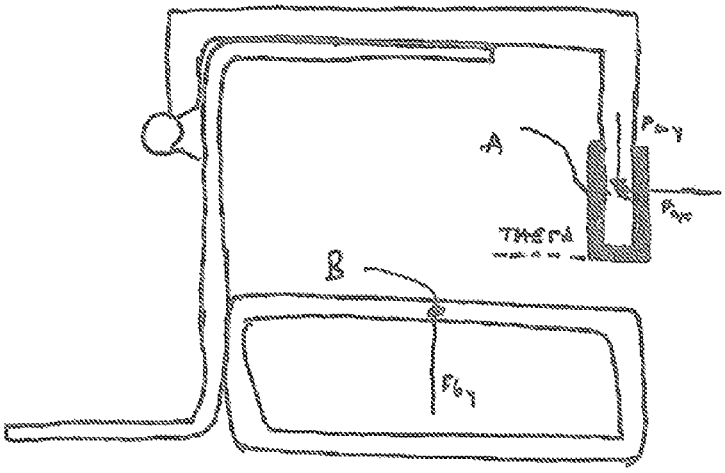
FIG. 18 shows a side column of the present invention and the resulting forces from an engaged wind lock contemplated by the present invention.

In prior art side columns—like that seen in FIG. 3 and FIG. 17 which shows the side column of FIG. 3 and various forces imparted on a door panel and side column as a result of engagement (and any wedge effect resulting) of the same—the forces imparted are different than those of the present invention, which can be seen for example in FIG. 18. The forces in the x-direction (Fax) can be found as follows:

$$Fax=Tx$$

$$Tx=Fw/2\ \tan(\text{THETA})$$

$$Fax=Fw/2\ \tan(\text{THETA})$$

Using the forces in the x-direction, the perpendicular force (Fa) on the side column and the force in the y-direction (Fy) can be calculated as follows:

$$Fa=Fax/\sin(\text{THETA}\ SC)$$

$$Fay=Fax/\tan(\text{THETA}\ SC)$$

Where THETA SC is the angle of the side column as shown, for example, in FIG. 17. Using the calculation for the forces in the y-direction, the total sum of the forces in the y-direction (Fby) can be calculated as follows:

$$Fby=Fay+Ty$$

$$Ty=Fw/2$$

$$Fby=Fax/\tan(\text{THETA}\ SC)+Fw/2$$

Using the forces on both the door panel and side column, the frictional forces on each side column and the door panel can be found. Each contact point between the side column and the door panel (and any wind locks) will have a coefficient of friction. At point A in FIG. 17, this coefficient of friction may be represented as COFa, and at point B this coefficient of friction may be represented as COFb. The force of friction on each side column (Ff) can be calculated as follows:

$$Ff=Fa*COFa+Fby*COFb$$

If COF=COFa=COFb, assuming the same materials are used for each part of the side column, then the force of friction on each side column becomes:

$$Ff=COF*(Fa+Fby)$$

Inasmuch as both side columns engage the door panel, the total friction on the door panel (Ft) will equal 2×Ff.

The following calculations demonstrate the wedge effect of the 45 degree prior art wind lock without taking into account any wind load. Without a wind load, Ty=0. The comparison between a prior art side column utilizing angled side columns and wind locks and the side columns and wind locks of the present invention shows a significant reduction in the force of friction when the side columns and wind locks of the present invention are used.

Using a standard angle of 45 degrees for THETA SC in a prior art side column like that shown in FIG. 17 and the formulas established above, this will result in the following frictional forces:

$$Ff=COF(Fa+Fby)$$

$$Fa=Fax/\sin(45)=1.414Fax$$

$$Fby=Fay+Ty$$

$$Fay=Fax/\tan(45)=Fax$$

$$Ty=0$$

$$Ff=2.414*COF*Fax$$

This shows that, before taking into effect wind load, the frictional force for each prior art side column having a 45 degree angle will be equal to approximately 2.414 multiplied by the coefficient of friction at points A and B multiplied by the force of friction in the x-direction at the side column.

For the present invention, the angle THETA SC will be 90 degrees. Using the equations established above, the following frictional forces for each side column, before taking into account any wind load, can be calculated:

$$Ff=COF(Fa+Fby)$$

$$Fa=Fax/\sin(90)=Fax$$

$$Fby=Fay+Ty$$

$$Fay=0(\text{only an } x\text{-directional component})$$

$$Ty=0$$

$$Ff=COF*Fax$$

As seen from the resulting calculations, the force of friction on each side column in the present invention is 2.414 times less than a standard 45 degree angled side column in the prior art. This reduction in friction results in less wear on both the door panel and the side column and helps preserve the motor used to open and close the door panel.

When factoring in a wind load, the frictional force on a 45 degree angled wind lock will vary slightly. For a side column and door assembly for the present invention, the force of friction under a wind load becomes:

$$Ff(90)=COF(Fa+Fby)$$

$$Fa=Fax$$

$$Fay=0(\text{only an } x\text{-directional component})$$

$$Fby=Ty=Fw/2$$

$$Ff(90)=COF(Fax+Fw/2)$$

$$Fax=[Ff(90)-(Fw/2)]/COF$$

For a prior art design utilizing a 45 degree angle, the force of friction under wind load becomes:

$$Ff(45)=2.414*COF*Fax$$

From above, $Ff(45)=2.414*COF*[Ff(90)-(Fw/2)]/COF$ $$Ff(45)=2.414[Ff(90)-(Fw/2)]$$

As seen from this calculation, the factor by which the frictional force is decreased in a door assembly utilizing the present invention will be reduced, however the amount of reduction in friction will vary dependent on the wind load on the door panel.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

We claim:

1. An overhead roll-up door assembly for selectively opening and closing an opening bounded by a top, a bottom, and opposing side edges, the overhead roll-up door assembly door assembly comprising:

a door panel having a top edge, a bottom edge, a first face, a second face, and opposing vertical edges;

at least two wind locks, each wind lock having a thickness and being attached proximate a different opposing vertical edge, each wind lock including a first edge and a second edge wherein the first edge extends substantially perpendicular to the first or second face of the door panel, the first edge being located a distance from the opposing vertical edge proximate the respective wind lock, the second edge is at least partially located between the first edge and the bottom edge of the door panel, and the second edge is beveled such that it extends vertically from the first or second face of the door panel at an angle to the door panel; and at least two side columns positioned on opposite sides of the opening such that one side column is proximate each opposing side edge of the opening, each side column having a base portion and an outer cover portion, each outer cover portion including a parallel portion and a perpendicular portion, wherein each parallel portion is substantially parallel to, and spaced apart from, the respective base portion, each parallel portion being spaced apart from the respective base portion a first distance and defining an area between there between, the area at least partially defining a vertical channel in each side column for engaging and guiding the door panel as the door panel is opened and closed; and each perpendicular portion extends substantially perpendicular from the respective parallel portion in a direction towards the respective base portion, each perpendicular portion terminating before extending to the respective base portion so that a gap extending a second distance is formed there between, the second distance being less than the first distance between the respective parallel portion and the respective base portion, wherein, the thickness of the door panel and each wind lock is greater than the gap in each side column, and each perpendicular portion engages one of the at least two wind locks when a wind load is applied to the door panel to prevent the door panel from escaping the vertical channel in each side column.

2. The overhead roll-up door assembly of claim 1 wherein each wind lock includes a top face, wherein at least one of a portion of at least one of the door panel located proximate the first edge, the first edge, and the top face are covered in polyethylene terephthalate (PET) fabric.

3. The overhead roll-up door assembly of claim 1 wherein each side column includes a guard piece, the guard piece being operably attached to the perpendicular portion proximate the gap between the perpendicular portion and the base portion, the guard piece being configured to engage each respective wind lock when a wind load is applied to the door panel.

4. The overhead roll-up door assembly of claim 1 wherein each second edge engages the perpendicular portion of each respective side column when the transverse force impacts the door panel, the second edge being capable of passing through and expanding the gap in each respective side column by rotating the outer cover portion of the respective side column.

5. The overhead roll-up door assembly of claim 1 wherein each second edge extends laterally across the first or second face of the door panel at an angle to each respective first edge.

6. The overhead roll-up door assembly of claim 5 wherein each second edge extends laterally across the first or second face of the door panel at a second angle to each respective first edge, the second edge beginning proximate the respective first edge and terminating proximate the opposing vertical edge proximate the respective wind lock the second edge being at a third angle to the bottom edge of the door panel.

7. The overhead roll-up door assembly of claim 1 wherein each wind lock includes an exterior edge opposite each respective first edge, wherein each exterior edge is positioned closer to the opposing vertical edge proximate each respective wind lock than the first edge and each exterior edge extends vertically from the first or second face of the door panel.

8. The overhead roll-up door assembly of claim 7 wherein each second edge extends laterally across the first or second face of the door panel between the respective first edge and the respective exterior edge.

9. The overhead roll-up door assembly of claim 8 wherein each second edge extends between the first edge and the respective exterior edge and at an angle of 60 degrees to the bottom edge of the door panel.

10. The overhead roll-up door assembly of claim 1 wherein each side column includes a mounting bolt, the mounting bolt operably attaching the respective outer cover portion to each respective side column.

11. The overhead roll-up door assembly of claim 10 wherein each side column includes a resilient member, the resilient member being operably connected to each side column by the respective mounting bolt, each resilient member allowing the outer cover portion of each side column to rotate, expanding the gap in each side column to allow the engaged wind lock and vertical edge to escape the side column when a transverse force impacts the door panel.

12. The side column of claim 11 wherein the resilient member comprises one of a steel washer or a rubber washer.

* * * * *